US006964618B2

(12) United States Patent
Klein

(10) Patent No.: US 6,964,618 B2
(45) Date of Patent: Nov. 15, 2005

(54) GOLF CLUB SHAFT SUPPORT

(76) Inventor: Roger Allen Klein, 348 Greenbriar Dr., Ravenna, OH (US) 44266

( * ) Notice: Subject to any disclaimer, the term of this patent is extended or adjusted under 35 U.S.C. 154(b) by 0 days.

(21) Appl. No.: 10/827,590

(22) Filed: Apr. 19, 2004

(65) Prior Publication Data

US 2005/0233823 A1 Oct. 20, 2005

(51) Int. Cl.[7] ..... A63B 55/10
(52) U.S. Cl. ..... 473/282
(58) Field of Search ..... 473/282, 286, 473/408; D21/796; 248/152, 174, 176.1

(56) References Cited

U.S. PATENT DOCUMENTS 3,891,177 A * 6/1975 Jerrel ..... 248/352
4,063,731 A 12/1977 Kitay
4,210,334 A 7/1980 Lind
4,545,579 A 10/1985 McCain
4,805,911 A 2/1989 Ferlazzo et al.
4,832,338 A 5/1989 Magazzi
4,991,839 A 2/1991 Lumbattis, Jr.
RE33,735 E * 11/1991 Rumble et al. ..... 473/323
5,116,046 A * 5/1992 Pace ..... 473/286
5,127,530 A 7/1992 Ortuno
5,149,087 A 9/1992 Thompson, Jr.
5,152,524 A 10/1992 Brown
5,226,647 A 7/1993 Notarmuzi
5,230,385 A 7/1993 Dinatale
5,230,507 A 7/1993 White et al.
5,285,990 A 2/1994 Engel
5,292,120 A 3/1994 Pehoski et al.
D351,444 S 10/1994 Hunter
D354,688 S 1/1995 Barrett et al.
5,401,019 A 3/1995 Wissman et al.
D360,248 S 7/1995 Wright
D360,451 S 7/1995 Levocz et al.
5,437,449 A 8/1995 Zink
D363,849 S 11/1995 Bruns et al.
5,467,980 A 11/1995 Weisenstein
5,474,191 A 12/1995 Bergeron et al.
5,482,247 A 1/1996 Smith
5,492,230 A 2/1996 Horton
5,503,394 A 4/1996 Mauck et al.
5,529,299 A 6/1996 Bellagamba
D377,511 S 1/1997 Glennon
5,624,328 A 4/1997 Lovich
5,636,754 A 6/1997 Ennis
5,645,500 A 7/1997 Borden
5,704,847 A * 1/1998 Glennon ..... 473/282
5,730,404 A 3/1998 Evans et al.
5,733,208 A 3/1998 Fazekas
5,743,276 A 4/1998 Tamayo-Rivera et al.
5,759,120 A 6/1998 Mathis et al.

(Continued)

*Primary Examiner*—Stephen Blau

(57) ABSTRACT

A rigid or semi-rigid, one-piece, shaped, planar golf club shaft support is provided for supporting the grip of a golf club above wet ground and/or grass on the golf course. The support has at least one lead-in entry and circular cutout positioned opposite an essentially flat base edge for receiving a golf club shaft. When the support is placed on the ground with the cutout containing the shaft upward and the base edge sitting on the ground, the grip end of the shaft is securely supported above the wet ground and/or grass and stays dry, and the club head rests on the ground to form a very stable support system that cannot be overturned or dislodged easily. The planar opposed front and back surfaces of the support may be imprinted with appropriate information and the support also used as a bag tag, promotional item, or drink coaster.

26 Claims, 5 Drawing Sheets

U.S. PATENT DOCUMENTS 5,769,740 A 6/1998 Colangelo
5,782,443 A 7/1998 La Fontaine
5,782,704 A 7/1998 Tetler et al.
5,813,414 A 9/1998 Zutler et al.
5,820,479 A 10/1998 Cline et al.
D400,611 S 11/1998 Schoenbeck
D400,612 S 11/1998 Rubin
D401,295 S 11/1998 Young
5,873,471 A 2/1999 Ruggeri
5,884,881 A 3/1999 Band et al.
5,890,970 A 4/1999 Donati
D414,537 S * 9/1999 Crate ..... D21/796
6,022,280 A 2/2000 Arenburg et al.
6,030,298 A 2/2000 Tate
6,050,905 A 4/2000 Tate
6,159,107 A 12/2000 Walton
6,162,137 A 12/2000 Jones et al.
6,234,916 B1 5/2001 Carusillo et al.
6,260,717 B1 7/2001 Keller, Jr.
D447,530 S 9/2001 Hidalgo
6,315,133 B1 11/2001 Franke
6,346,051 B1 2/2002 Otsubo
6,363,941 B1 4/2002 Combs
D457,213 S 5/2002 Davies
6,482,103 B1 11/2002 Vache
6,497,327 B1 12/2002 Rindfleisch
6,514,159 B2 2/2003 Hendren
D471,613 S 3/2003 Richardson

* cited by examiner

GOLF CLUB SHAFT SUPPORT

BACKGROUND OF THE INVENTION

The present invention relates to the game of golf and provides a golf club shaft support for securing the grip of a spare club above wet grounds so that the grip remains dry during play. The one-piece, shaped, water resistant, rigid or semi-rigid support contains a lead-in entry and cutout positioned opposite an essentially flat base edge. The lead-in entry and cutout may be placed over the shaft of a golf club and the base edge of the support placed on the ground to securely support the golf club grip above the ground.

In addition to the physical requirements of the game of golf, weather conditions also can have an impact on a golfer's performance. Among these conditions are wet fairways, wet roughs and wet greens caused by dew, drizzle, rain, and golf course watering systems. Quite often during a round of golf, a golfer will remove more than one club at a time from the bag or cart and lay the extra club on the ground while playing a stroke with the other club. This event occurs most frequently when golf carts are prohibited from traversing fairways, on hilly terrain and around the greens. When wet conditions are present the extra club's grip will become wet and slippery from lying on the wet ground. A person familiar with the game of golf knows that a stroke made with a wet golf club grip is difficult, if not impossible, to control.

Various devices have been developed to support a golf club shaft above the level of the wet grass in order to keep the grip dry. Such devices generally fall into two categories: 1) devices having a lower portion with one or more prongs or spikes that are inserted into the ground and having an upper portion with an indentation, slot, or other means for engaging the golf club shaft in a position to support the golf club grip above the ground; and 2) devices having a lower portion that sits on the ground and an upper portion with an indentation, hook, or other means for engaging the golf club shaft in a position to support the golf club grip above the ground.

The devices in category 1 have the disadvantage of leaving holes or doing other damage to the golf course, which is particularly undesirable on the putting green. In addition, it may be difficult to penetrate the ground with the device when the ground is very hard. Some of these devices also have long shafts that are inconvenient to carry around on the golf course and are best suited for use on the driving range.

U.S. Pat. No. 5,116,046 to Pace is an example of the golf club supports in category 1. Pace discloses a golf tool having an upper section containing two curved resilient legs and a bottom section containing two wedge shaped legs that must be driven into the ground for stability. In order to attach the Pace tool to the shaft of a golf club, the shaft is forced against the two resilient legs to spread the legs apart and allow the shaft to enter and be held as the legs retract onto the shaft.. The Pace tool, therefore, may cause damage to the golf course, especially the greens, by penetrating the ground; and also may cause damage to the golf club shaft by forcing the shaft between the legs of the tool and holding the shaft in place by friction.

Another example of the golf club supports in category 1 is U.S. Pat. No. 5,226,647 to Notarmuzi, which also discloses a golf tool having prongs for penetrating the ground and a cutout with a lead-in neck defining a golf club grip stand. Thus, the Notarmuzi device also may cause damage to the golf course, especially to the greens. The cutout of Notarmuzi is adapted to receive the lower end of a golf club shaft, which then may be slipped upward toward the grip of the club. The Notarmuzi golf tool is designed to perform a number of functions in addition to supporting a golf club grip, and is the approximate size of a divot repair tool. Thus the effective vertical height of the golf club shaft support portion of the tool is very small when the prongs are inserted into the ground for stability, and the tool is ineffective as a golf club shaft support in taller grass.

The devices in category 2 do not require penetration of the ground. Some of these devices, however, are designed to remain attached to the golf club. Therefore, the golfer would have to purchase a separate device for nearly every club in the bag. Other devices in this category are rather bulky and are inconvenient to carry except in the golf bag or on the golf cart.

U.S. Pat. No. 5,704,847 to Glennon is an example of the golf club supports in category 2. Glennon discloses a small flexible plastic card with dimensions similar to a wallet sized credit card. The flexible card has concave notches formed in the sides for supporting a golf club grip. The flexible card also may have a small hole for receiving an attachment cord and has relatively flat surfaces for receiving printed advertising. The Glennon card support, however, does not secure the golf club shaft, thus making it an extremely unstable system that will collapse from under the golf club at the slightest disturbance. The flexibility of the Glennon card support also adds to the instability of the support system. In use, the golfer must hold the card vertically on an edge on the ground with one hand, while balancing the spare club upon the card with the other hand until finding a position in which the card will support the weight of the club without falling over. Furthermore, the Glennon card's short dimensions make it ineffective as a golf club shaft support in taller grasses.

BRIEF SUMMARY OF THE INVENTION

The present invention avoids the disadvantages and shortcomings of prior art golf club shaft supports by the use of a novel shaped planar member having a lead-in entry and circular cutout positioned opposite an essentially flat base edge. Thus, it is an object of the invention to provide a convenient, easy to use, one-piece, shaped, stable, secure golf club shaft support that will keep the golf club grip dry when the golf course is wet without leaving marks, holes, or other damage to the golf course; or damaging the golf club shaft.

It is another object of the present invention to provide a golf club shaft support as above that cannot not easily be tipped over or dislodged by slight inadvertent contact by a golfer or a golfer's equipment.

It is another object of the present invention to provide a golf club shaft support as above that does not require forcing the shaft through a restricted opening, which may damage the shaft.

It is another object of the present invention to provide a golf club shaft support as above that is small enough to carry in the golfer's pocket so as to be always accessible when needed, yet is large enough to raise the golf club grip above wet grass on the golf course.

It is another object of the present invention to provide a golf club shaft support as above that has a flat surface of sufficient area to also serve as a bag tag, autograph board, promotional item, or drink coaster when imprinted with suitable information.

It is another object of the present invention to provide a golf club shaft support as above that can be mass produced inexpensively in large volume.

To accomplish these objectives, the present invention provides a rigid or semi-rigid, one-piece, shaped, planar golf club support having at least one lead-in entry and circular cutout positioned opposite an essentially flat base edge. The lead-in entry to the cutout is sized to be larger than the diameter of a golf club shaft at the hosel and smaller than the diameter of a golf club shaft at the grip. The cutout is sized to be larger than the lead-in entry and no larger than the diameter of a golf club shaft near the grip. Thus, the golf club shaft near the hosel easily fits through the lead-in entry and into the cutout and the support may be slipped up the shaft into a position where it is held securely, but not tightly, on the shaft. When the support is placed on the ground with the cutout containing the shaft facing upward and the base edge sitting on the ground, the grip end of the shaft is securely supported above the wet ground and grass and stays dry, and the club head rests on the ground to form a very solid, stable support system that cannot be overturned or dislodged easily.

The shaped support is sized to fit into a golfer's pocket, but has a base edge long enough to provide a stable base for supporting the golf club shaft. The perpendicular distance from the base edge to the opposing cutout is greater than the normal height of the grass on a golf course fairway and even the height of many areas of rough.

Thus, the golf club shaft support of the present invention overcomes the disadvantages and shortcomings of prior art devices because the support does not penetrate the ground and therefore does not leave holes, marks or other damage to the golf course, especially the putting greens; is not likely to damage the golf club shaft because no pressure or friction is needed to attach it to the shaft; when attached to the golf club is not easily tipped over or dislodged by slight inadvertent contact by a golfer or a golfer's equipment; is always available because it can be carried in the golfer's pocket; has flat surface areas large enough to serve as a bag tag, autograph board, promotional item, or drink coaster when imprinted with suitable information, and can be manufactured inexpensively in large volume.

BRIEF DESCRIPTION OF THE DRAWINGS

These and other advantages of the golf club shaft support of the present invention will be apparent from the following detailed description of the invention and from the drawings in which.

DETAILED DESCRIPTION OF THE INVENTION

Figure 1:
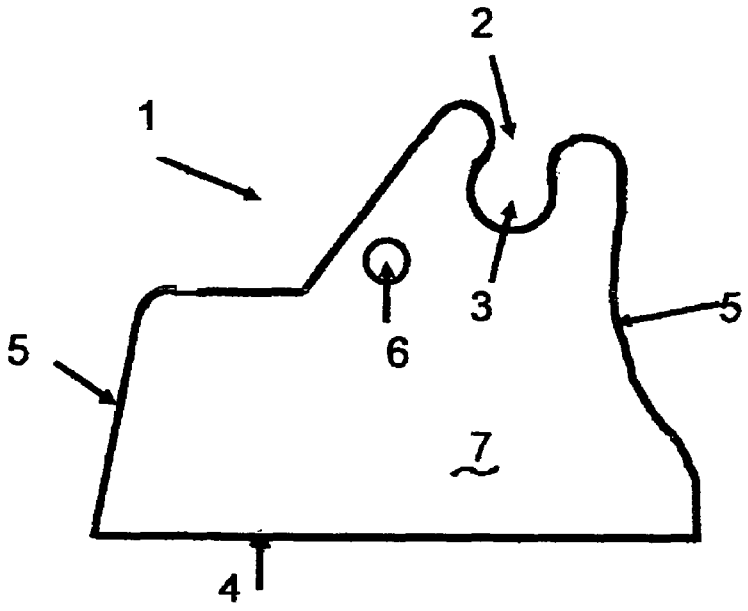
FIG. 1 is a plan view of a general embodiment of the golf club shaft support of the present invention.

The present invention provides a novel golf club shaft support, generally designated at 1 in the drawings, for elevating a golf club grip above the surface of wet ground and/or grass. The support comprises a rigid or semi-rigid, one-piece, shaped, planar member having at least one lead-in entry 2 and circular cutout 3 positioned opposite an essentially flat base edge 4; the lead-in entry being joined to each end of the base edge 4 by connecting edges 5, each of which connecting edges 5 may be composed of any number of straight and/or curved segments, in a manner such that the center of gravity of the support is directly above a portion of the base edge 4 when the support is placed on the ground and/or grass with the cutout 3 facing upward and the base edge 4 sitting on the ground and/or grass.

The one piece shaped planar member may be formed from a variety of rigid or semi-rigid water resistant materials, such as plastic, metal and wood. The preferred material is plastic because of its light weight, low cost, and availability. Rigid PVC foam board or high impact resistant styrene is most preferred due to their excellent printability characteristics, that is, their ability to accept inks and paints.

As shown in FIG. 1, the one piece shaped planar member has a lead-in entry 2 leading to a circular cutout 3 positioned opposite an essentially flat base edge 4. The diameter of a golf club shaft gradually tapers from the hosel to the grip. The diameter of a golf club shaft at the hosel is about 0.3 inch to about 0.42 inch. The diameter of a golf club shaft at the bottom of the grip is about 0.42 inch to about 0.6 inch. Therefore, the width of the lead-in entry 2 preferably is about 0.3 inch to about 0.42 inch, and most preferably is about 0.37 inch. The edges of the lead-in entry 2 are smoothly curved and join smoothly into the cutout to avoid sharp corners or edges that might damage the golf club shaft.

The diameter of the circular cutout 3 controls the distance that the shaped planar support can slide up the golf club shaft towards the grip before engaging the golf club shaft. If engagement with the shaft occurs close to the club head the support system is less stable than if the support can slide to a position near the grip. Therefore, the diameter of the cutout 3 preferably is from about 0.45 inch to about 0.6 inch, and most preferably is about 0.5 inch to allow the cutout 3 to slide to a position near the golf club grip before engaging the shaft.

A hole 6 may be formed completely through the shaped planar member near one of the edges to accommodate a cord, chain, bag tag strip, clip, or other means for attaching the support to the golf bag when the golfer has finished the round of golf, or when the support is being used as a bag tag.

As shown in FIG. 1 the lead-in entry 2 is joined to the ends of the base edge by two connecting edges 5. The connecting edges 5 shown in FIG. 1 represent connecting edges that may be composed of any number of straight and/or curved segments. The connections of the connecting edges 5 with the lead-in entry 2 and with the ends of the base edge 4 preferably are smoothly curved.

Figure 3:
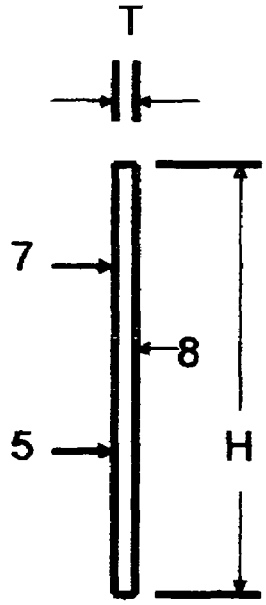
FIG. 3 is a view of a connecting edge of the golf club shaft support of FIG. 1.
Figure 2:
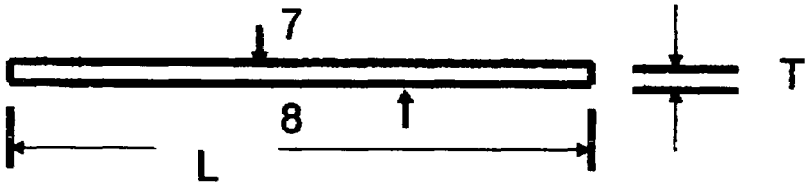
FIG. 2 is a view of a base edge of the golf club shaft support of FIG. 1.

Since a golf club shaft support may be needed any time that wet grass is encountered on the golf course, it is desirable that the support be small enough to fit conveniently into a golfer's pocket. Therefore, as shown in FIGS. 1 and 2, the length L of the base edge 4 of the shaped planar member must be large enough to provide support for a golf club, but small enough to fit into a golfer's pocket. Preferably, the length of the base edge of the member is about 4 inches to about 5.5 inches. Most preferably, the length L of the base edge is about 4.75 inches. As shown in FIGS. 1 and 3, the height H of the member is the perpendicular distance between the base edge and the upper most point of the member. The height of the member must be large enough to raise the grip of a golf club above wet ground and/or grass, but small enough to fit into a golfer's pocket. Preferably, the height of the member is about 3 inches to about 4 inches. Most preferably, the height H of the member is about 3.5 inches.

As shown in FIGS. 2 and 3, the shaped planar member has a pair of planar opposed front and back surfaces 7 and 8. The thickness of the shaped member is shown by the dimension T and is the distance between the front surface 7 and the back surface 8. The shaped member should be as thin as possible to avoid unnecessary weight and bulk, but must be of sufficient thickness to make the support rigid or semi-rigid. Therefore, the thickness of the triangularly shaped member depends on the material used in the member. Preferably the thickness of the member is about ⅛inch. Each of the front and back surfaces 7 and 8 provides a large area which may be imprinted with suitable information when the support will be used as a bag tag, promotional item, or drink coaster.

Figure 7:
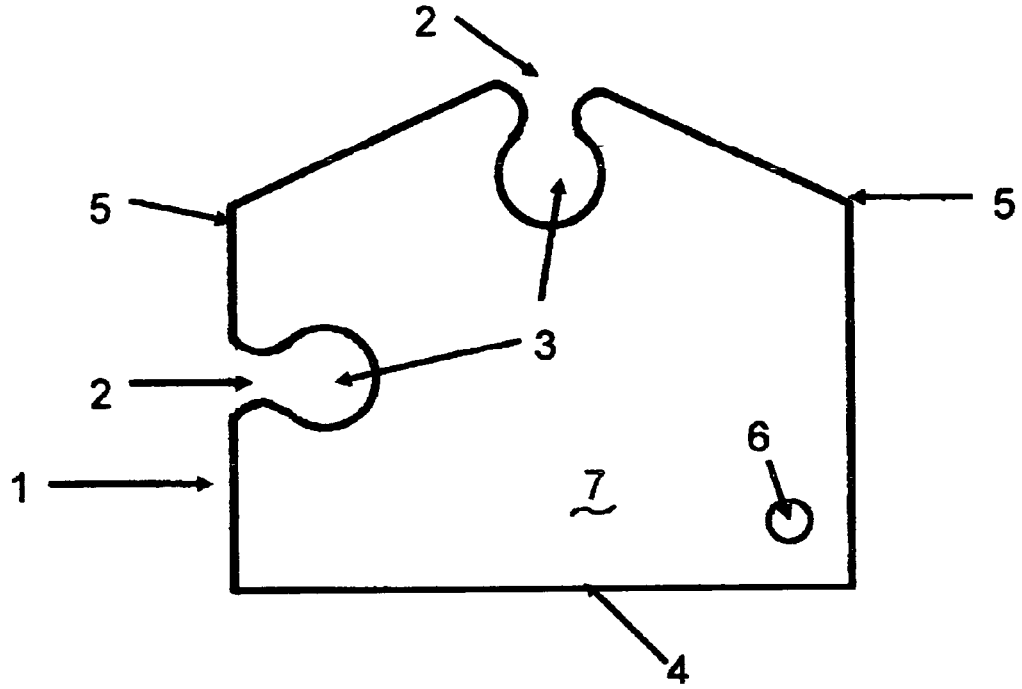
Figure 8:
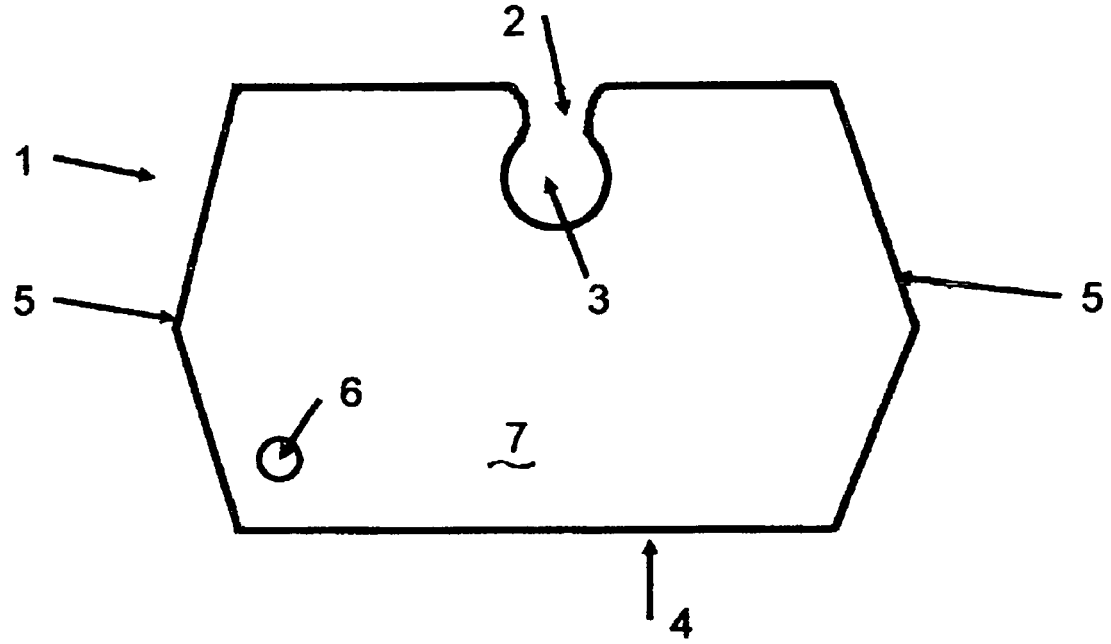

If the shaped planar member has one lead-in entry 2 leading to a cutout 3, the cutout preferably should be opposite the longer base edge 4 to provide maximum stability to the support system. If the shaped member also has a second lead-in entry 2 leading to a second cutout 3, the golf club grip can be supported at a greater height above the ground by placing the golf club shaft in the second cutout and placing the shorter base edge opposite the second cutout on the ground, as shown by the specific embodiments of the present invention in FIGS. 4 and 7.

Figure 4:
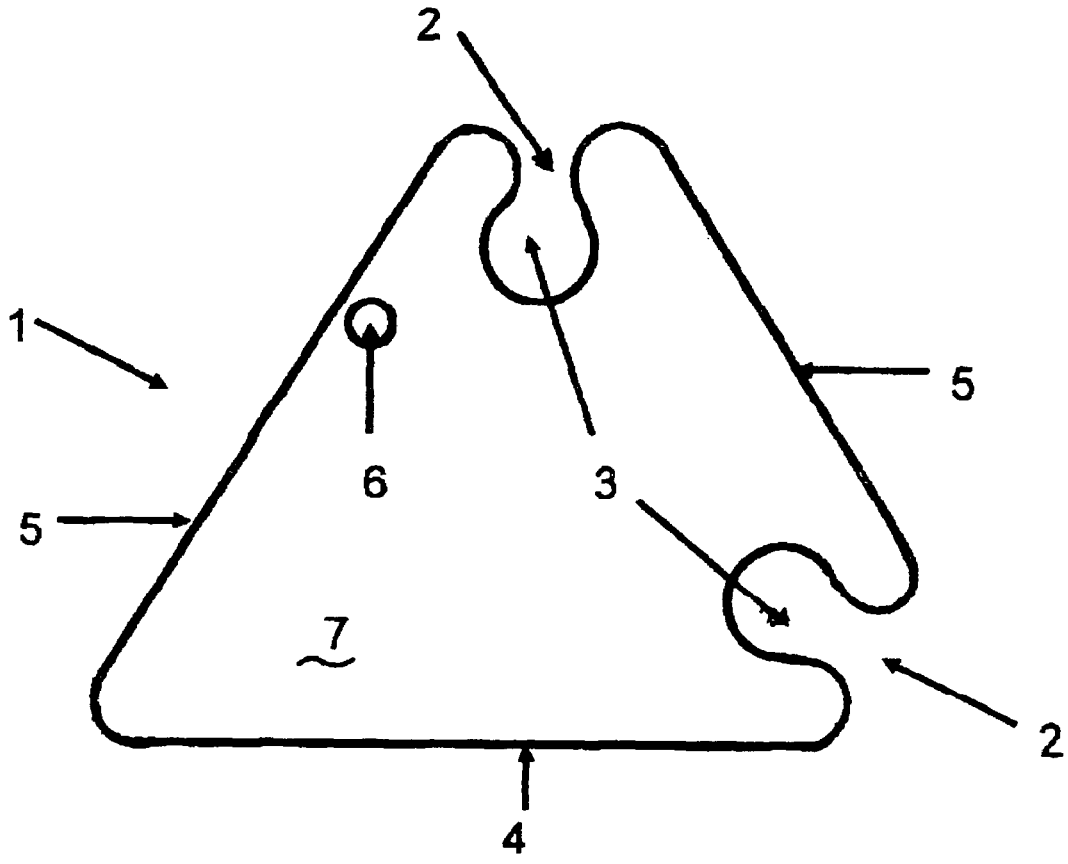
FIGS. 4–8 are plan views of specific embodiments of the golf club shaft support of FIG. 1.
Figure 5:
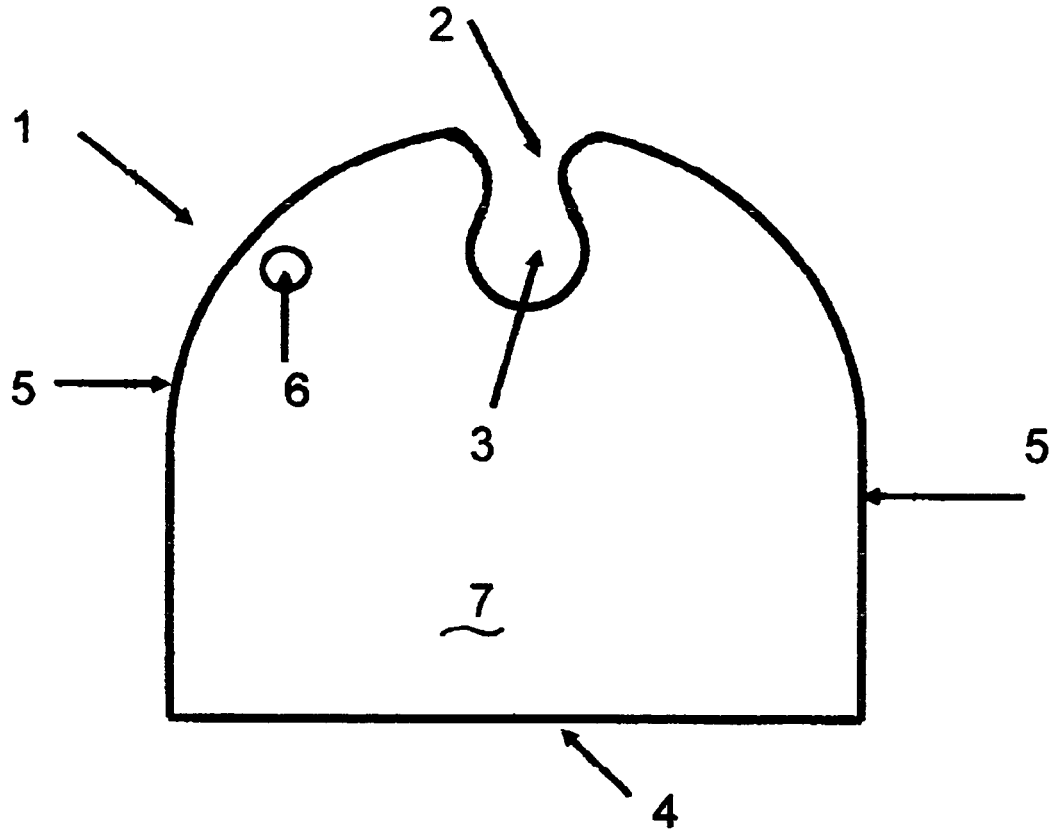
Figure 6:
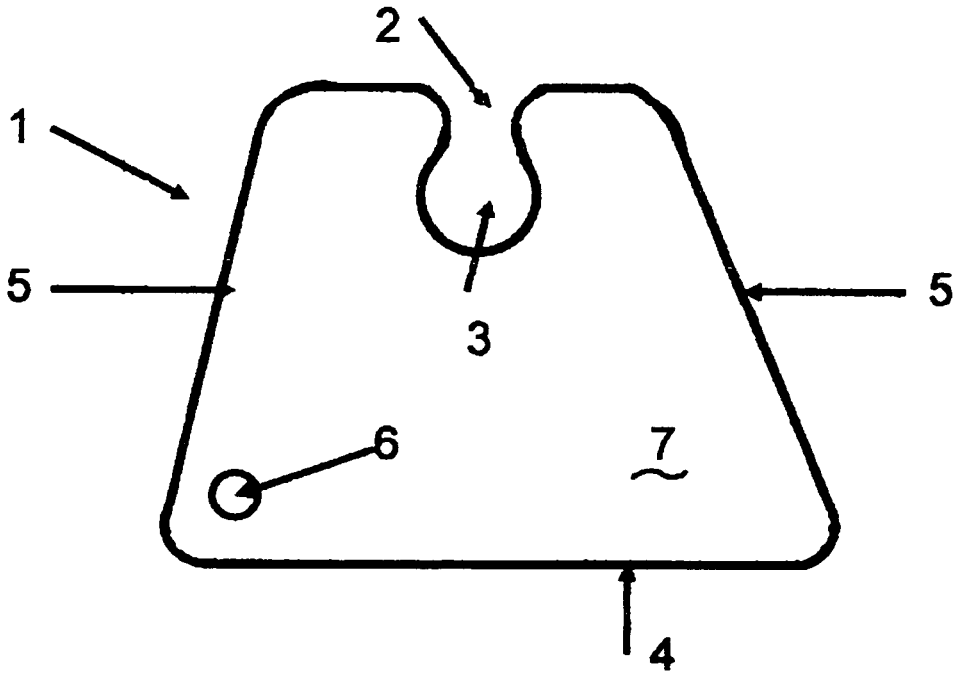

Several specific embodiments of shaped planar golf club shaft support of the present invention are shown in FIGS. 4 to 8. The preferred configuration of the shaped planar golf club shaft support is a generally triangular shape as shown in FIG. 4.

Figure 9:
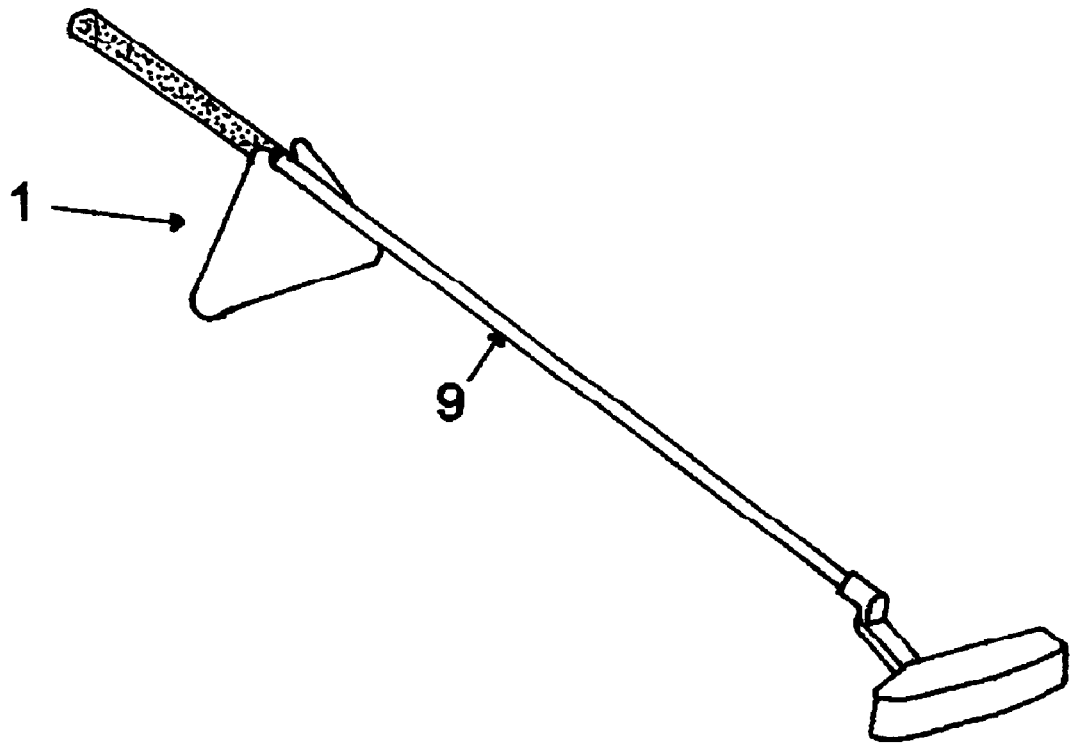
FIG. 9 is a diagrammatic perspective view showing the golf club shaft support of the present invention supporting the shaft of a golf club above the ground.

FIG. 9 is a diagrammatic perspective view showing a golf club shaft support 1 of the present invention supporting the shaft 9 of a golf club off the ground.

The preferred plastic, one-piece, shaped, planar golf club shaft support of the present invention may be manufactured by use of a punch press, by injection molding, or by using other methods well known in the art of making plastic parts. If production of a large number of the supports is desired, injection molding is the preferred method of manufacture. The golf club shaft support of the present invention also may be made from metal, wood, or other rigid or semi-rigid water resistant materials by methods well known in those arts.

The one-piece, rigid or semi-rigid, shaped, planar golf club shaft support of the present invention is easily attached to a golf club, and easily removed after use, so that the golfer's concentration is not broken by these actions. As shown in FIG. 9, the golf club shaft 9 at its smallest diameter slips easily through the lead-in entry and into the cutout of the support. The golfer then moves the support along the shaft until the diameter of the cutout is essentially equal to the diameter of the golf club shaft, places the head of the golf club on the ground, adjusts the position of the support if necessary to assure that the golf club grip will be above the wet grass, and then places the base edge of the support on the ground with the cutout facing upward. The cutout 3 of the support secures the golf club shaft at an upward angle to the ground thereby suspending the grip above the wet ground or other supporting surface. Maximum stability generally is attained when the head of the golf club lies on the ground with the face pointing upward.

Preferably the support is used in a position at least one-third of the distance from the hosel to the bottom of the golf club grip since the stability of the support system is decreased as the support is moved closer to the hosel. Most preferably the support is used in the position on the golf club shaft where the diameter of the cutout is essentially equal to the diameter of the golf club shaft. It is not necessary to force the golf club shaft support into tight contact with the golf club shaft. In fact, it is undesirable to do so because the support may scuff a graphite golf club shaft. The grips of additional golf clubs also may be kept dry by placing the club heads on the ground and laying the grips of the additional golf clubs across the grip of the club that is secured by the cutout of the shaped support of the present invention. The support is easily removed from the golf club shaft by moving it toward the hosel until the shaft can be slipped out of the cutout and through the lead-in entry.

While the present invention has been described in terms of a general embodiment, several specific embodiments, and the preferred embodiments, it is recognized that persons skilled in this art will readily perceive many modifications and variations in the embodiments described above. Such modifications and variations are included within the scope of the present invention.

I claim:

1. A golf club shaft support comprising a rigid or semi-rigid, one piece, shaped, planar member; the shaped planar member having at least one lead-in entry and circular cutout positioned opposite an essentially flat base edge, the base edge having a length of about 4 inches to about 5.5 inches; the shaped planar member also having flat planar opposed front and back surfaces, and having a height H; the lead-in entry being joined to each end of the base edge by two connecting edges, each of which connecting edges is able to be composed of any number of straight and/or curved segments, in a manner such that the center of gravity of the support is directly above a portion of the base edge when the support is placed on the ground and/or grass with the cutout facing upward and the base edge sitting on the ground and/or grass.

2. The support of claim 1 wherein the shaped planar member is made of plastic, metal, wood, or other water resistant, rigid or semi-rigid material.

3. The support of claim 2 wherein the shaped planar member is made of plastic.

4. The support of claim 3 wherein the plastic is rigid PVC foam board or high impact resistant styrene.

5. The support of claim 1 wherein the width of the lead-in entry is about 0.3 inch to about 0.42 inch,

6. The support of claim 5 wherein the width of the lead-in entry is about 0.38 inch.

7. The support of claim 1 wherein the diameter of the circular cutout is about 0.45 inch to about 0.6 inch.

8. The support of claim 7 wherein the diameter of the circular cutout is about 0.5 inch.

9. The support of claim 1 wherein the length of the base edge is about 4.75 inches.

10. The support of claim 1 wherein the height of the member is about 3 inches to about 4 inches.

11. The support of claim 10 wherein the height of the member is about 3.5 inches.

12. The support of claim 1 wherein the shaped planar member has a generally triangular shape.

13. The support of claim 1 wherein a hole is formed completely through the shaped planar member near one of the edges to accommodate an attaching means.

14. The support of claim 1 wherein at least one surface is imprinted with information.

15. A golf club shaft support comprising a rigid or semi-rigid, one piece, generally triangular shaped, planar member made of plastic; the member having at least one lead-in entry and circular cutout positioned opposite an essentially flat base edge; the member having a pair of generally triangular shaped planar opposed front and back surfaces; and the lead-in entry of the member being joined to each end of the base edge by two straight connecting edges in a manner such that the center of gravity of the support is directly above a portion of the base edge when the support is placed on the ground and/or grass with the cutout facing upward and the base edge sitting on the ground and/or grass.

16. The support of claim 15 wherein the plastic is rigid PVC foam board.

17. The support of claim 15 wherein the member has a generally isosceles triangular shape.

18. The support of claim 15 wherein the width of the lead-in entry is about 0.3 inch to about 0.42 inch.

19. The support of claim 18 wherein the width of the lead-in entry is about 0.38 inch.

20. The support of claim 15 wherein the diameter of the circular cutout is about 0.45 inch to about 0.6 inch.

21. The support of claim 20 wherein the diameter of the circular cutout is about 0.5 inch.

22. The support of claim 15 wherein the length of the base edge is about 4 inches to about 5.5 inches.

23. The support of claim 22 wherein the length of the base edge is about 4.75 inches.

24. The support of claim 15 wherein the height of the member is about 3 inches to about 4 inches.

25. The support of claim 24 wherein the height of the member is about 3.5 inches.

26. The support of claim 15 wherein at least one surface is imprinted with information.

* * * * *